US009605901B2

(12) United States Patent
Ryu et al.

(10) Patent No.: US 9,605,901 B2
(45) Date of Patent: Mar. 28, 2017

(54) CLOTHING DRYER

(71) Applicant: SAMSUNG ELECTRONICS CO., LTD., Suwon-si, Gyeonggi-do (KR)

(72) Inventors: Koang Hun Ryu, Hwaseong-si (KR); Chang Bae Yeom, Yongin-si (KR); Dong Jun Lee, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 451 days.

(21) Appl. No.: 13/966,784

(22) Filed: Aug. 14, 2013

(65) Prior Publication Data

US 2014/0059877 A1 Mar. 6, 2014

(30) Foreign Application Priority Data

Aug. 29, 2012 (KR) ..... 10-2012-0095176

(51) Int. Cl.

| | |
|---|---|
| ***D06F 58/00*** | (2006.01) |
| ***F26B 21/00*** | (2006.01) |
| ***D06F 58/20*** | (2006.01) |
| *D06F 58/04* | (2006.01) |
| *D06F 58/26* | (2006.01) |

(52) U.S. Cl.

CPC ..... *F26B 21/004* (2013.01); *D06F 58/20* (2013.01); *D06F 58/04* (2013.01); *D06F 58/263* (2013.01)

(58) Field of Classification Search

CPC ..... F26B 21/004; F26B 21/001; D06F 58/20; D06F 58/04; D06F 58/263; D06F 58/26; F23D 91/02; F23D 2206/0094; F23R 3/04; F16L 21/08

USPC ..... 34/132; 285/403

See application file for complete search history.

(56) References Cited

U.S. PATENT DOCUMENTS

| | | | | |
|---|---|---|---|---|
| 528,045 | A * | 10/1894 | Vanvorce | F16L 21/08 285/403 |
| 3,826,607 | A * | 7/1974 | Kuhn | D06F 58/263 34/595 |
| 2004/0123487 | A1* | 7/2004 | Han | D06F 58/263 34/595 |
| 2006/0174511 | A1* | 8/2006 | Lee | D06F 58/263 34/605 |
| 2009/0183386 | A1* | 7/2009 | Freese | D06F 58/263 34/551 |

FOREIGN PATENT DOCUMENTS

| | | |
|---|---|---|
| KR | 10-2005-0054200 | 6/2005 |
| KR | 10-2006-0077257 | 7/2006 |

OTHER PUBLICATIONS

Chinese Office Action dated Jan. 23, 2017 from Chinese Patent Application No. 201310384853.5, 8 pages.

* cited by examiner

*Primary Examiner* — Kenneth Rinehart
*Assistant Examiner* — Bao D Nguyen
(74) *Attorney, Agent, or Firm* — Staas & Halsey LLP

(57) ABSTRACT

A clothing dryer including a rear duct having an intake port and a lower duct connected to the intake port to guide air to the rear duct. The lower duct is elastically supported by elastic support protrusions extending from the rear duct. Even when vibration generated during the operation of the clothing dryer is transmitted to the lower duct or the rear duct, therefore, noise generated due to collision between the lower duct and the rear duct is suppressed.

12 Claims, 7 Drawing Sheets

CLOTHING DRYER

CROSS-REFERENCE TO RELATED APPLICATIONS

This application claims the benefit of Korean Patent Application No. 10-2012-0095176, filed on Aug. 29, 2012 in the Korean Intellectual Property Office, the disclosure of which is incorporated herein by reference.

BACKGROUND

1. Field

Embodiments of the present disclosure relate to a clothing dryer where an installation structure of a lower duct to guide suction of air is improved.

2. Description of the Related Art

Generally, a clothing dryer is a device that rotates a drying drum having wet laundry placed therein at low speed, in a state in which high-temperature air is passed through the drying drum, to dry the laundry in the drying drum.

The clothing dryer includes a housing forming the external appearance thereof, a drying drum rotatably mounted in the housing, the drying drum being formed in the shape of a cylinder open at the front and rear thereof to receive laundry therein, a drive unit to rotate the drying drum, an intake channel to guide air such that the air is introduced into the drying drum, and an exhaust channel, in which a blowing fan to generate suction force and blowing force is mounted, to guide air such that the air is discharged from the drying drum. The air passes through the drying drum through the intake channel and the exhaust channel to dry the laundry in the drying drum.

The intake channel includes a lower duct disposed in the housing to suction air from the housing and a rear duct having an intake port, to which the lower duct is connected, to guide the air suctioned through the lower duct to the drying drum.

SUMMARY

It is an aspect of the present disclosure to provide a clothing dryer where an installation structure of a lower duct mounted in an intake port is improved to suppress noise generated from the lower duct during the operation of the clothing dryer.

Additional aspects of the disclosure will be set forth in part in the description which follows and, in part, will be apparent from the description, or may be learned by practice of the disclosure.

In accordance with one aspect of the present disclosure, a clothing dryer includes a drying drum to dry laundry placed therein, a rear duct disposed at a rear of the drying drum, the rear duct having an intake port, through which air is suctioned, and a lower duct connected to the intake port to guide air to the intake port, wherein the rear duct includes at least one elastic support protrusion to elastically support the lower duct, and the elastic support protrusion includes an elastic part extending forward from the rear duct and a support part extending from the elastic part to support an outside of the lower duct.

The rear duct may include a connection pipe extending forward, the connection pipe forming the intake port, and the elastic support protrusion may extend from the connection pipe.

A front end of the support part to support the lower duct may be formed in an arc shape.

The elastic part may be provided at a middle portion thereof with a curved part.

The at least one elastic support protrusion may include a plurality of elastic support protrusions arranged at intervals in a circumferential direction of the intake port.

The elastic support protrusions may include one elastic support protrusion to support a top of the lower duct and a pair of elastic support protrusions to support opposite sides of the lower duct, and a bottom of a rear end of the lower duct may be supported by a bottom of the intake port.

The lower duct may be provided at a rear end thereof, which is mounted in the intake port, with a guide groove corresponding to the support part.

The guide groove may have a width and depth gradually increasing toward a rear thereof.

The lower duct may be formed such that a rear end of the lower duct has a smaller diameter than the intake port, whereby an outer circumference of the lower duct is partially spaced apart from an inner circumference of the intake port.

The lower duct may be formed in the shape of a hollow circular truncated cone.

The lower duct may include a first duct formed in the shape of a hollow circular truncated cone, a rear end of the first duct being mounted in the intake port, and a second duct formed in the shape of a hollow circular truncated cone, a rear end of the second duct being mounted in a front end of the first duct, and the elastic support protrusion may elastically support the first duct.

The clothing dryer may further include a burner to heat air in the lower duct.

The elastic part may extend forward from the rear duct, and the support part may extend toward an inner side of the lower duct in a radial direction.

In accordance with another aspect of the present disclosure, a clothing dryer includes a drying drum to dry laundry placed therein, a rear duct disposed at a rear of the drying drum, the rear duct having an intake port, through which air is suctioned, and a lower duct connected to the intake port to guide air to the intake port, wherein the lower duct is formed such that a rear end of the lower duct, which is mounted in the intake port, has a smaller diameter than the intake port, whereby an outer circumference of the lower duct is partially spaced apart from an inner circumference of the intake port, and the rear duct includes at least one elastic support protrusion to elastically support the lower duct.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
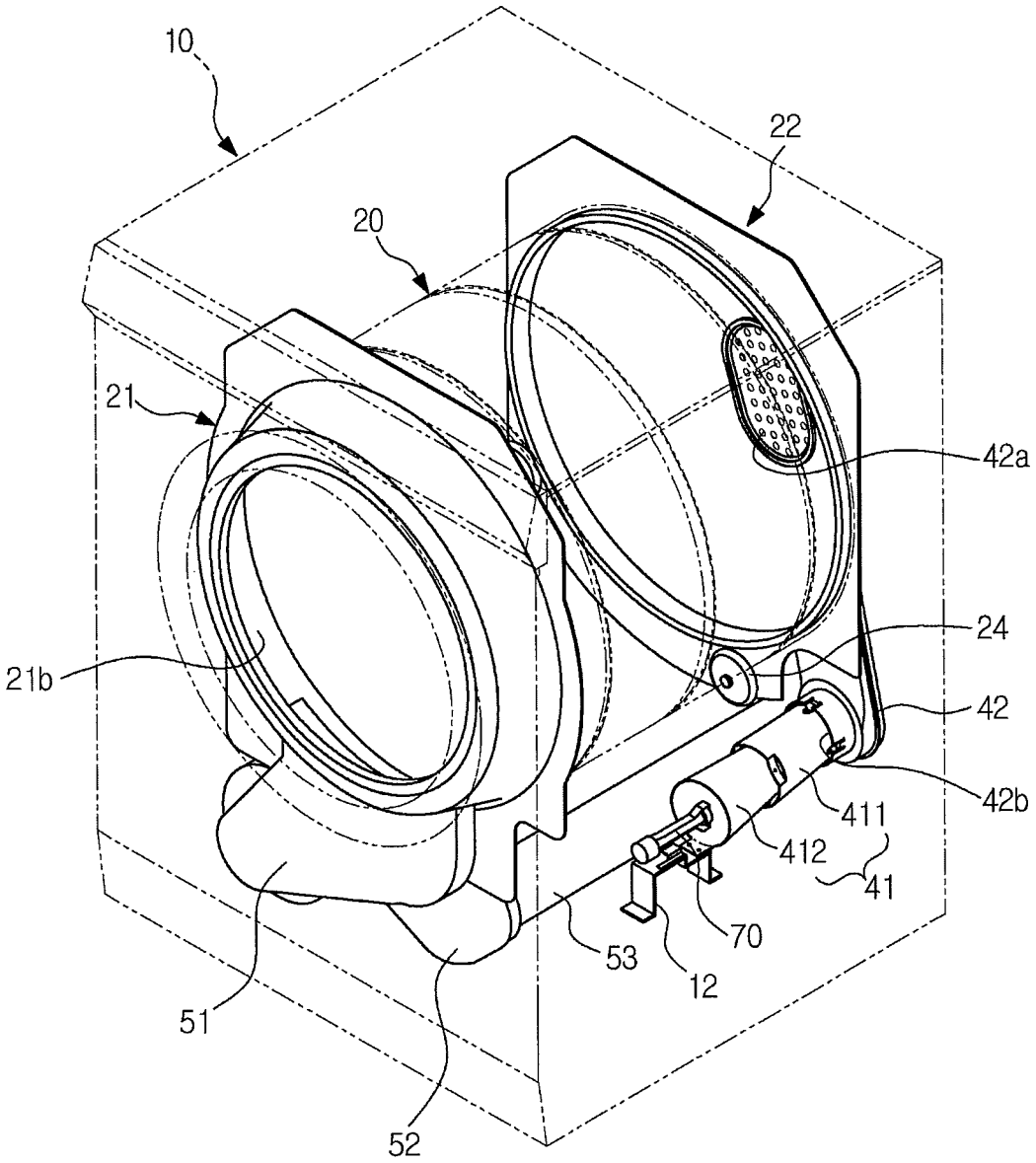
FIG. 1 is a perspective view showing the internal structure of a clothing dryer according to an embodiment of the present disclosure.

Reference will now be made in detail to the embodiments of the present disclosure, examples of which are illustrated in the accompanying drawings, wherein like reference numerals refer to like elements throughout.

Figure 2:
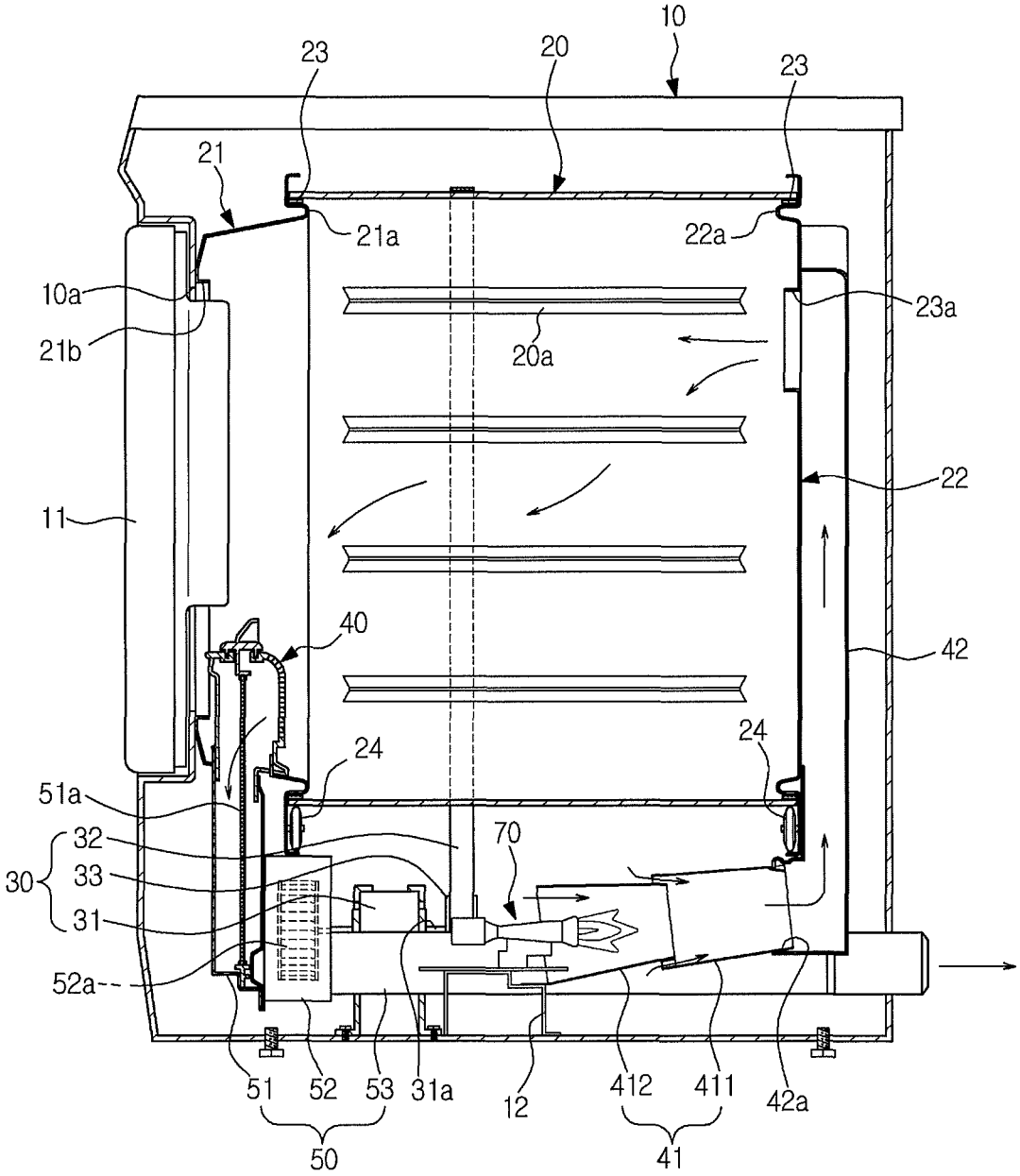
FIG. 2 is a sectional view of the clothing dryer according to the embodiment of the present disclosure.
Figure 3:
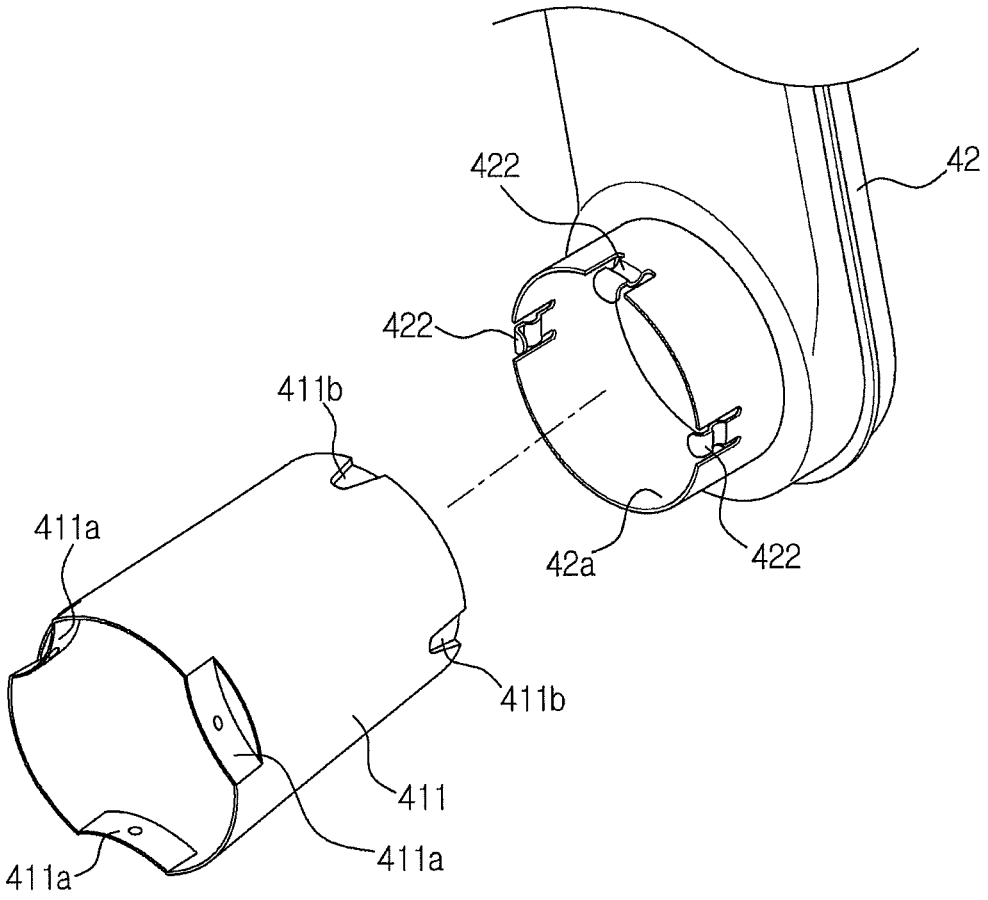
FIG. 3 is an exploded perspective view showing a state in which a first duct is mounted in a rear duct in the clothing dryer according to the embodiment of the present disclosure.
Figure 4:
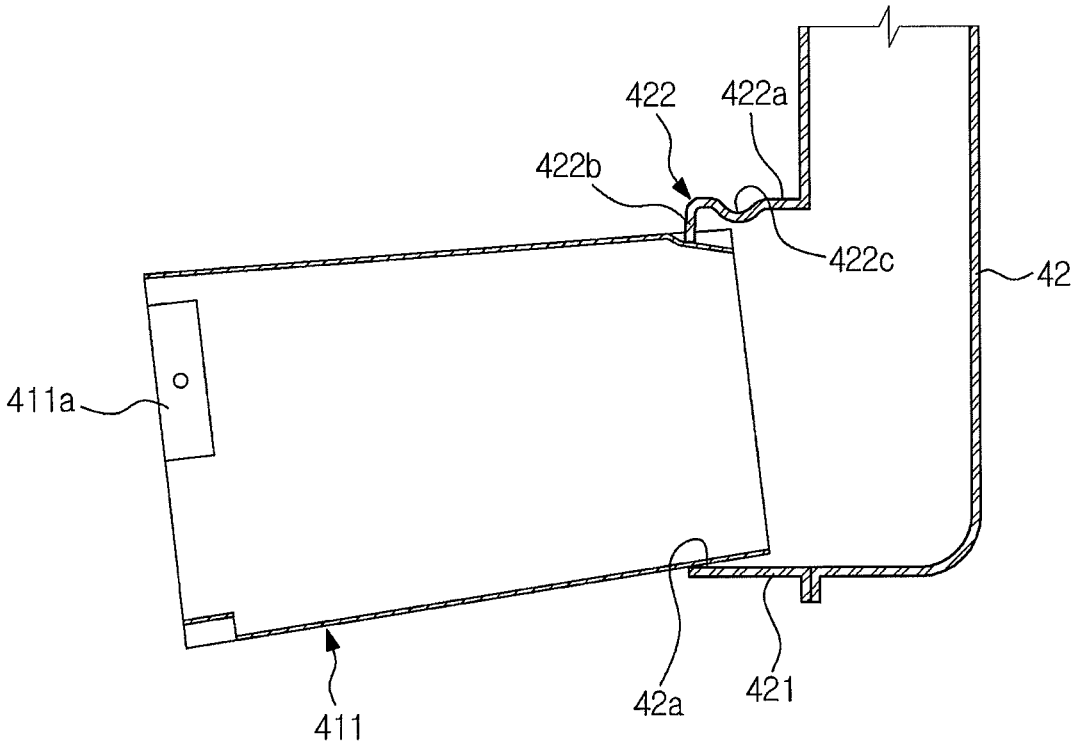
FIG. 4 is a side sectional view showing the state in which the first duct is mounted in the rear duct in the clothing dryer according to the embodiment of the present disclosure.
Figure 5:
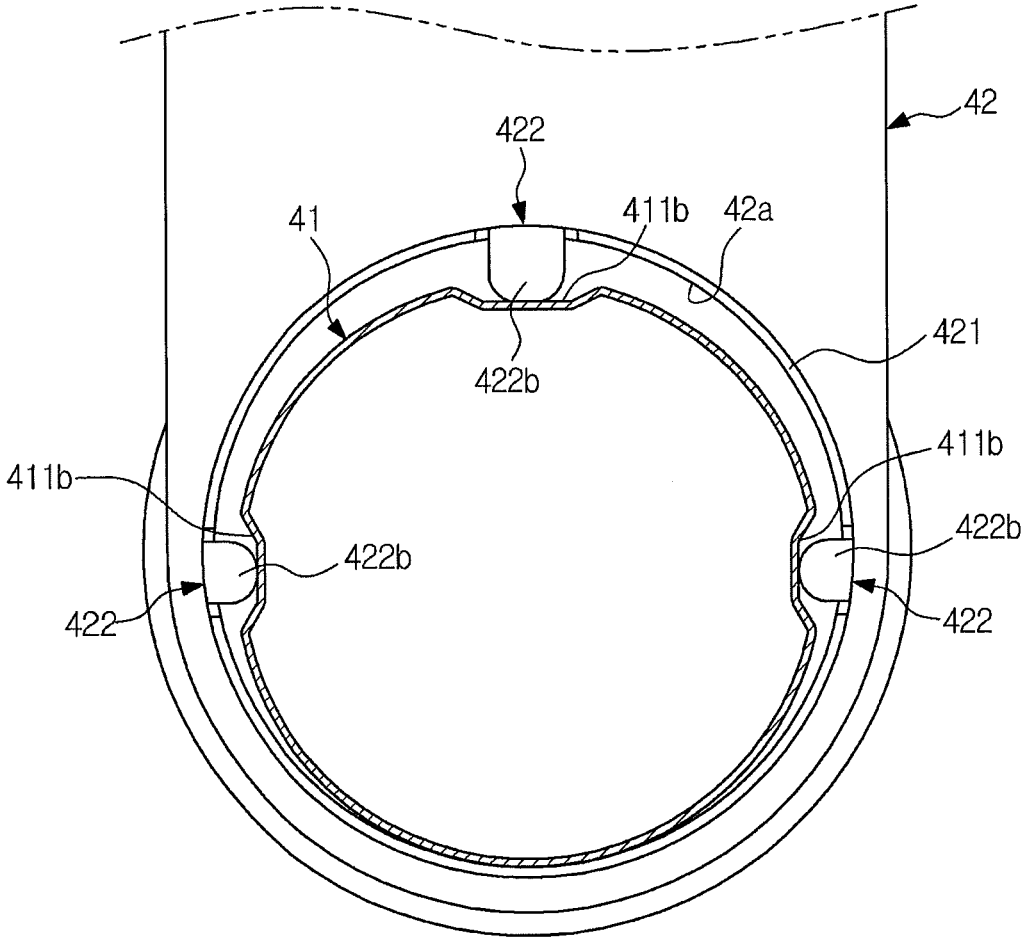
FIG. 5 is a front sectional view showing the state in which the first duct is mounted in the rear duct in the clothing dryer according to the embodiment of the present disclosure.

As shown in FIGS. 1 and 2, a clothing dryer according to an embodiment of the present disclosure includes a housing 10 forming the external appearance thereof, a drying drum 20 rotatably mounted in the housing 10 to dry clothing, a drive unit 30 to rotate the drying drum 20, an intake channel 40 to guide air such that the air is suctioned into the drying drum 20, and an exhaust channel 50 to guide air such that the air is discharged from the drying drum 20.

The drying drum 20 is formed in the shape of a cylinder open at the front and rear thereof. A plurality of lifters 20*a* to lift laundry upward is disposed at the inner circumference of the drying drum 20. A front support plate 21 is fixedly mounted to the housing 10 at the front side of the drying drum 20 to cover the open front of the drying drum 20 and to rotatably support the front of the drying drum 20. Also, a rear support plate 22 is fixedly mounted to the housing 10 at the rear side of the drying drum 20 to cover the open rear of the drying drum 20 and to rotatably support the rear of the drying drum 20.

A front support part 21*a* protruding into the front end of the drying drum 20 to rotatably support the front end of the drying drum 20 is provided at the front support plate 21. Also, a rear support part 22*a* protruding into the rear end of the drying drum 20 to rotatably support the rear end of the drying drum 20 is provided at the rear support plate 22. A friction reduction member 23 to minimize frictional resistance is disposed between the front end of the drying drum 20 and the front support part 21*a*. Also, another friction reduction member 23 to minimize frictional resistance is disposed between the rear end of the drying drum 20 and the rear support part 22*a*. A roller 24 to rotatably support the drying drum 20 is mounted at the lower part of the front support plate 21. Also, another roller 24 to rotatably support the drying drum 20 is mounted at the lower part of the rear support plate 22.

Circular introduction ports 10*a* and 21*b*, through which laundry is introduced into or withdrawn from the drying drum 20, are formed at the front of the housing and the front support plate 21, respectively. At the front of the housing 10 is mounted a door 11 to open and close the introduction ports 10*a* and 21*b*.

The drive unit 30 to rotate the drying drum 20 includes a drive motor 31 mounted at inside lower part of the housing 10 and a pulley 32 and belt 33 to transfer power from the drive motor 31 to the drying drum 20. The belt 33 is arranged such that the belt 33 is wound on the outside of the pulley 32 coupled to one end of a rotary shaft 31*a* of the drive motor 31 and the outside of the drying drum 20 to rotate the drying drum 20 according to the rotation of the drive motor 31.

The intake channel 40 includes a lower duct 41 mounted under the drying drum 20 in the housing 10 to guide air from the housing 10 to a rear duct 42, which will hereinafter be described, and the rear duct 42 mounted at the rear of the rear support plate 22 to guide air suctioned through the lower duct 41 to a communication hole 23*a* formed at the upper part of the rear support plate 22.

In the lower part of the housing 10 is disposed a burner 70 to heat air in the rear duct 42 through the lower duct 41. Gas is supplied to the burner 70. The burner 70 burns the gas to heat air. In this embodiment, a portion of the rear end of the burner 70, from which gas is injected, is disposed in the lower duct 41 to burn the gas in the lower duct 41. As a result, air in the lower duct 41 is heated.

A fixing bracket 12 to fix the burner 70 is disposed at the inner bottom of the housing 10. The burner 70 is mounted at the upper side of the fixing bracket 12. Also, the front end of the lower duct 41 is fixed to the upper side of the fixing bracket 12.

In this embodiment, the lower duct 41 is formed in the shape of a hollow circular truncated cone having a rear end of a smaller diameter and a front end of a larger diameter. The lower duct 41 includes a first duct 411 and a second duct 412 sequentially arranged in the axial direction.

The rear end of the first duct 411 is connected to the rear duct 42, and the rear end of the second duct 412 is connected to the front end of the first duct 411. Since the first duct 411 and the second duct 412 are formed in the shape of a hollow circular truncated cone having a rear end of a smaller diameter and a front end of a larger diameter as described above, the front end of the second duct 412 has a smaller diameter than the rear end of the first duct 411. As a result, air may be introduced into a gap between the front end of the second duct 412 and the rear end of the first duct 411. At the front end of the first duct 411 is provided a plurality of installation parts 411*a* protruding toward the inside of the first duct 411 such that the rear end of the second duct 412 is installed at the installation parts 411*a*.

At the lower part of the rear duct 42 is provided a connection pipe 421 forming an intake port 42*a*, to which the rear end of the first duct 411 is connected such that air guided through the lower duct 41 is introduced. The rear end of the first duct 411, connected to the intake port 42*a*, has a smaller diameter than the intake port 42*a*. Consequently, the inner circumference of the intake port 42*a* is at least partially spaced apart from the outer circumference of the first duct 411. In this structure, air may be suctioned through a space between the inner circumference of the intake port 42*a* and the outer circumference of the first duct 411. As a result, a larger amount of air may be introduced into the rear duct 42.

The rear duct 42 includes elastic support protrusions 422 to elastically support the lower duct 41. In this embodiment, the elastic support protrusions 422 extend from the connection pipe 421 to elastically support the outside of the first duct 411 of the lower duct 41. The elastic support protrusions 422 stably maintain a state in which the lower duct 41 is mounted in the intake port 42*a* even though the inner circumference of the intake port 42*a* is at least partially spaced apart from the outer circumference of the first duct 411.

A plurality of elastic support protrusions 422 is provided to elastically support the lower duct 41. In this embodiment, the elastic support protrusions 422 include one elastic support protrusion 422 to support the top of the lower duct 41 and two elastic support protrusions 422 to support opposite sides of the lower duct 41. The bottom of the rear end of the first duct 411 is in surface contact or line contact with the inner circumference of the connection pipe 421 forming the inner circumference of the intake port 42*a*.

In a case in which the lower duct 41 is elastically supported by the three elastic support protrusions 422 and the bottom of the first duct 411 is supported by the connection pipe forming the intake port 42*a* as described above, the bottom of the rear end of the first duct 411 is in surface contact or line contact with the inner circumference of the connection pipe 421, thereby stably maintaining a state in which the rear end of the second duct 412 is mounted in the connection pipe 421.

Each elastic support protrusion 422 includes an elastic part 422*a* extending forward from the rear duct 42 to provide elastic force and a support part 422*b* extending from the elastic part 422*a* toward the inner side of the lower duct 41 in the radial direction to support the outer circumference of the lower duct 41. In this embodiment, the rear end of the first duct 411 of the lower duct 41 is mounted in the intake port 42*a*, and therefore, the support part 422*b* supports the outer circumference of the rear end of the first duct 411.

In this embodiment, the elastic part 422*a* is provided at a middle portion thereof with a curved part 422*c*, by which the elastic part 422*a* is more easily elastically deformed. The support part 422*b* is formed such that the front end of the support part 422*b* to support the circumference of the lower duct 41 has an arc-shaped section.

Also, the lower duct 41 is provided at the outer circumference of the rear end thereof with a guide groove 411*b* corresponding to the support part 422*b* such that the outer circumference of the lower duct 41 is more easily supported by the support part 422*b* of each elastic support protrusion 422 when the lower duct 41 is mounted in the intake port 42*a*. The guide groove 411*b* has a width and depth gradually increasing toward the rear thereof. Since the elastic support protrusions 422 support the top and the opposite sides of the lower duct 41 as described above, the guide grooves 411*b* are formed at the top and the opposite sides of the lower duct 41.

When the lower duct 41 is mounted in the intake port 42*a* in a state in which the guide grooves 411*b* are located at positions corresponding to the respective elastic support protrusions 422, therefore, the support parts 422*b* of the elastic support protrusions 422 move along the respective guide grooves 411*b*, and the elastic parts 422*a* of the elastic support protrusions 422 are gradually deformed outward in the radial direction about the respective curved parts 422*c*. Consequently, the lower duct 41 is easily mounted in the intake port 42*a* using small force.

In a case in which the lower duct 41 is elastically supported by the elastic support protrusions 422 with the above-stated construction, the elastic support protrusions 422 suppress collision between the lower duct 41 and the rear duct 42 due to vibration transferred to the lower duct 41 or the rear duct 42 during the operation of the clothing dryer. As a result, noise generated between the lower duct 41 and the rear duct 42 is suppressed.

As shown in FIG. 2, the exhaust channel 50 includes a filter case 51, mounted at the lower part of the front support plate 21, in which a filter member 51*a* to filter foreign matter from air discharged from the drying drum 20 is detachably mounted, a blowing case 52, connected to the lower part of the filter case 51, in which a blowing fan 52*a* to generate suction force and blowing force upon receiving rotary force from the drive motor is mounted, and an exhaust duct 53 connected to the rear of the blowing case 52 to guide air to the rear side such that the air is discharged from the housing.

Hereinafter, the operation of the clothing dryer with the above-stated construction according to the embodiment of the present disclosure will be described.

First, when the clothing dryer is turned on in a state in which laundry is placed in the drying drum 20, the drive motor 31 is driven to rotate the blowing fan 52*a* and the drying drum 20, and the burner 70 burns gas while injecting the gas into the lower duct 41 to heat air in the lower duct 41.

According to the rotation of the blowing fan 52*a*, high-temperature air, heated in the lower duct 41, is transmitted to the blowing case 52, in which the blowing fan 52*a* is mounted, through the rear duct 42, the drying drum 20, and the filter case 51 and is then discharged from the housing 10 through the exhaust duct 53.

The high-temperature air transmitted to the drying drum 20 dries the laundry in the drying drum 20 while passing through the drying drum 20. The air having passed through the drying drum 20 passes through the filter case 51. At this time, foreign matter is filtered from the air by the filter member 51*a*. As a result, the foreign matter is removed from the air.

Vibration generated during the operation of the clothing dryer may be transmitted to the lower duct 41 or the rear duct 42. Since the elastic support protrusions 422 elastically support the outer circumference of the first duct 411, the support parts 422*b* of the elastic support protrusions 422 remain in contact with the outer circumference of the first duct 411 even when the vibration is transmitted to the first duct 411. Consequently, noise generated due to collision between the first duct 411 and the elastic support protrusions 422 caused by the vibration is suppressed.

Also, in a case in which the lower duct 41 is elastically supported by the elastic support protrusions 422 as described above, the elastic support protrusions 422 may elastically support the lower duct 41 even when the size of the lower duct 41 partially varies due to tolerance.

Figure 6:
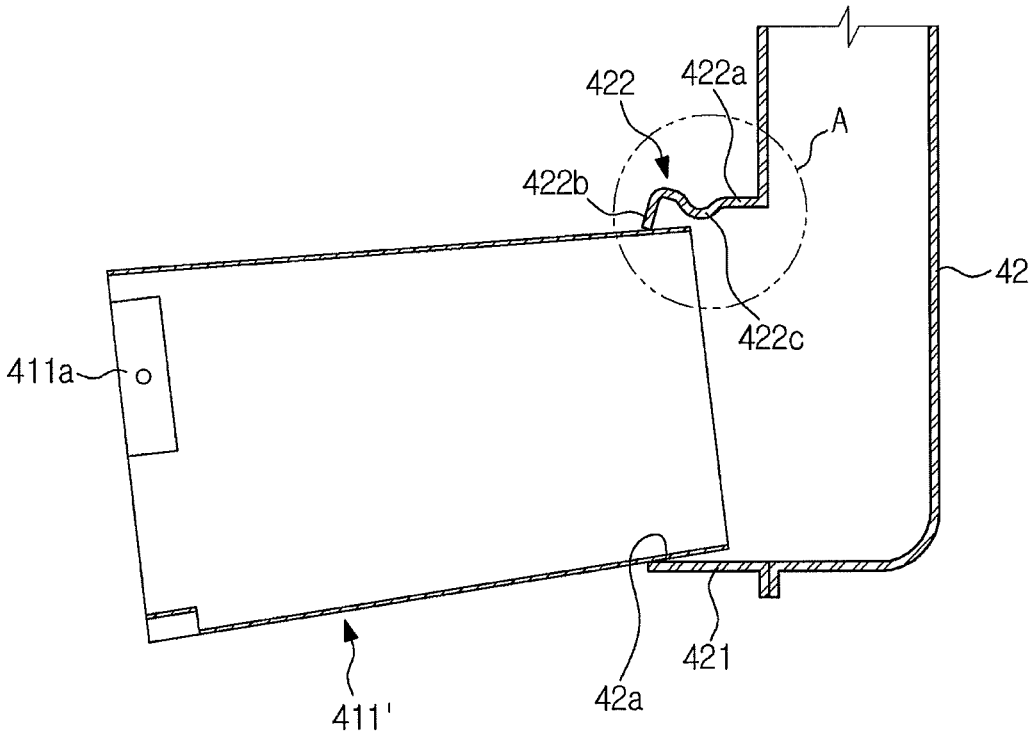
FIG. 6 is a side sectional view showing the state in which a first duct is mounted in a rear duct in a clothing dryer according to another embodiment of the present disclosure.
Figure 7:
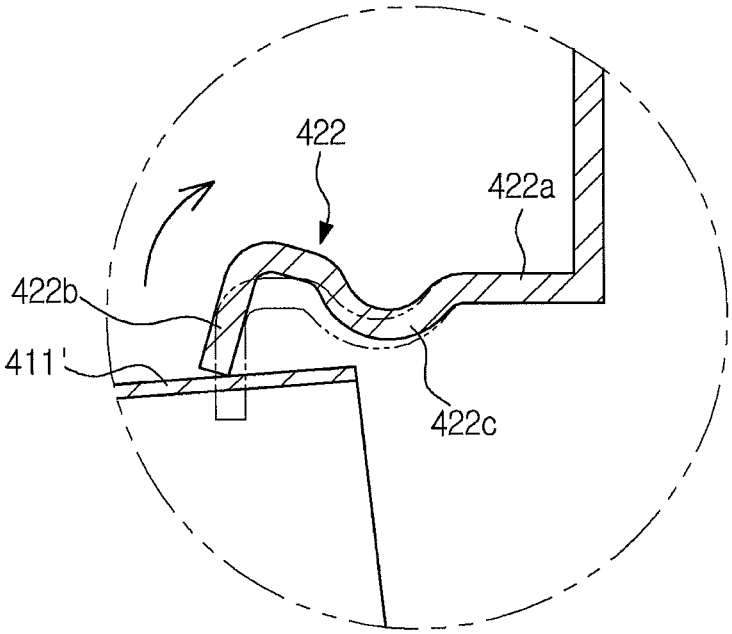
FIG. 7 is an enlarged view showing a state in which the first duct is supported by elastic support protrusions in FIG. 6.

In this embodiment, the lower duct 41 is provided with the guide grooves 411*b*, by which the lower duct 41 is more easily mounted in the intake port 42*a* via the elastic support protrusions 422. However, embodiments of the present disclosure are not limited thereto. As shown in FIG. 6, a first duct 411' having no guide grooves may be mounted in the intake port 42*a* via the elastic support protrusions 422. In the first duct 411' having no guide grooves, however, the elastic support protrusions 422 may be much more deformed than in the first duct 411 having the guide grooves 411*b* as shown in FIG. 7. Even in this case, the first duct 411' having no guide grooves may be mounted in the intake port 42*a* in the same manner as in the first duct 411 having the guide grooves 411*b*.

In this embodiment, three elastic support protrusions 422 are provided to support the top and opposite sides of the lower duct 41. However, embodiments of the present disclosure are not limited thereto. The lower duct 41 may be supported by only one elastic support protrusion 422 or four or more elastic support protrusions 422.

Also, in this embodiment, the bottom of the lower duct 41 is supported by the bottom of the intake port 42*a*. However, embodiments of the present disclosure are not limited thereto. The outer circumference of the rear end of the lower duct 41 may be completely spaced apart from the inner circumference of the intake port 42*a* by the elastic support protrusions 422.

Also, in this embodiment, the elastic parts 422*a* are provided with the curved parts 422*c*, by which the elastic parts 422*a* are more easily elastically deformed. However, embodiments of the present disclosure are not limited thereto. Even in a case in which the elastic parts 422*a* are not provided with the curved parts 422*c*, the elastic parts 422*a* may be elastically deformed such that the elastic support protrusions 422 elastic support the first duct 411.

As is apparent from the above description, the lower duct is supported by the elastic support protrusions. Even when vibration generated during the operation of the clothing dryer is transmitted to the lower duct or the rear duct, therefore, it is possible to suppress noise generated due to collision between the lower duct and the rear duct.

Also, since the elastic support protrusions are elastically deformed to support the lower duct as described above, it is possible to stably support the lower duct even when the diameter of the lower duct partially varies due to tolerance.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A clothing dryer comprising:

a drying drum to dry laundry placed therein;

a rear duct disposed at a rear of the drying drum, the rear duct having an intake port, through which air is suctioned; and a lower duct connected to the intake port to guide air to the intake port, wherein the rear duct comprises at least one elastic support protrusion to support the lower duct, the elastic support protrusion comprises an elastic part extending forward from the rear duct and a support part extending from the elastic part to support an outside of the lower duct, the lower duct is provided at a rear end thereof, which is mounted in the intake port, with a guide groove corresponding to the support part, and the guide groove has a width and depth increasing toward a rear thereof.

2. The clothing dryer according to claim 1, wherein the rear duct comprises a connection pipe extending forward, the connection pipe forming the intake port, and the elastic support protrusion extends from the connection pipe.

3. The clothing dryer according to claim 1, wherein a front end of the support part to support the lower duct is formed in an arc shape.

4. The clothing dryer according to claim 1, wherein the elastic part is provided at a middle portion thereof with a curved part.

5. The clothing dryer according to claim 1, wherein the at least one elastic support protrusion comprises a plurality of elastic support protrusions arranged at intervals in a circumferential direction of the intake port.

6. The clothing dryer according to claim 5, wherein the elastic support protrusions comprise one elastic support protrusion to support a top of the lower duct and a pair of elastic support protrusions to support opposite sides of the lower duct, and a bottom of a rear end of the lower duct is supported by a bottom of the intake port.

7. The clothing dryer according to claim 1, wherein the lower duct is formed such that a rear end of the lower duct has a smaller diameter than the intake port, whereby an outer circumference of the lower duct is partially spaced apart from an inner circumference of the intake port.

8. The clothing dryer according to claim 1, wherein the lower duct is formed in a shape of a hollow circular truncated cone.

9. The clothing dryer according to claim 1, wherein the lower duct comprises:

a first duct formed in a shape of a hollow circular truncated cone, a rear end of the first duct being mounted in the intake port; and a second duct formed in a shape of a hollow circular truncated cone, a rear end of the second duct being mounted in a front end of the first duct, wherein the elastic support protrusion supports the first duct.

10. The clothing dryer according to claim 1, further comprising a burner to heat air in the lower duct.

11. The clothing dryer according to claim 10, further comprising a fixing bracket to fix the burner, the fixing bracket being disposed at an inner bottom of a housing of the clothing dryer, wherein a front end of the lower duct is fixed to an upper side of the fixing bracket.

12. The clothing dryer according to claim 1, wherein the elastic part extends forward from the rear duct, and the support part extends toward an inner side of the lower duct in a radial direction.

* * * * *